US007881640B2

(12) United States Patent
Iwata et al.

(10) Patent No.: US 7,881,640 B2
(45) Date of Patent: Feb. 1, 2011

(54) MEMBER FOR AGITATING AND CONVEYING DEVELOPER, DEVELOPING DEVICE, AND IMAGE FORMING APPARATUS HAVING THE SAME

(75) Inventors: Naoya Iwata, Hadano (JP); Takashi Sakamoto, Ebina (JP); Yuya Kato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 356 days.

(21) Appl. No.: 12/105,437

(22) Filed: Apr. 18, 2008

(65) Prior Publication Data

US 2009/0092419 A1 Apr. 9, 2009

(30) Foreign Application Priority Data

Oct. 3, 2007 (JP) ..... 2007-260105

(51) Int. Cl.
*G03G 15/08* (2006.01)

(52) U.S. Cl. ..... 399/254; 399/256

(58) Field of Classification Search ..... 399/254–256
See application file for complete search history.

(56) References Cited

U.S. PATENT DOCUMENTS

| | | | | |
|---|---|---|---|---|
| 4,980,724 | A * | 12/1990 | Tanaka | 399/256 |
| 5,228,775 | A * | 7/1993 | Horn et al. | 366/278 |
| 5,758,238 | A * | 5/1998 | Mordenga et al. | 399/256 |
| 6,275,674 | B1 * | 8/2001 | Sugimoto | 399/254 |
| 2004/0179865 | A1 * | 9/2004 | Nishiyama | 399/254 |
| 2004/0265009 | A1 * | 12/2004 | Shigeta et al. | 399/254 |
| 2005/0123321 | A1 * | 6/2005 | Buhay-Kettelkamp et al. | 399/254 |
| 2007/0048023 | A1 * | 3/2007 | Thompson et al. | 399/254 |
| 2007/0122203 | A1 * | 5/2007 | Sugimoto et al. | 399/254 |

FOREIGN PATENT DOCUMENTS

| | | | |
|---|---|---|---|
| JP | 03-265877 | A | 11/1991 |
| JP | 5-43163 | A | 2/1993 |
| JP | 11-052727 | A | 2/1999 |
| JP | 2002-148915 | A | 5/2002 |

(Continued)

OTHER PUBLICATIONS

Japanese Office Action dated Dec. 22, 2009 in Japanese Application No. 2007-260105.
Chinese Office Action dated May 10, 2010 in Chinese application No. 200810097945.4.

*Primary Examiner*—David M Gray
*Assistant Examiner*—G. M. Hyder
(74) *Attorney, Agent, or Firm*—Sughrue Mion, PLLC

(57) ABSTRACT

A member for agitating and conveying a developer, includes: a rotation shaft that rotates in a given direction; a spiral-shaped conveying member that is disposed on an outer circumferential surface of the rotation shaft; and conveys a developer in a shaft direction of the rotation shaft; a protruded agitation section that protrudes, with a gap from the rotation shaft, from the spiral-shaped conveying member toward an upstream side in a developer conveying direction; and agitates the developer; and a diameter directional conveying section that is disposed between adjacent spires of the spiral-shaped conveying member; is disposed in a downstream side in the developer conveying direction with respect to the protruded agitation section; and gives a diameter directional conveying force to the developer.

12 Claims, 9 Drawing Sheets

FOREIGN PATENT DOCUMENTS

| | | | | |
|---|---|---|---|---|
| JP | 2003-295589 | A | | 10/2003 |
| JP | 3500920 | B2 | | 12/2003 |
| JP | 2005-326480 | A | | 11/2005 |
| JP | 2006-126484 | A | | 5/2006 |
| JP | 2006349732 | A | * | 12/2006 |
| JP | 2007225854 | A | * | 9/2007 |

* cited by examiner

MEMBER FOR AGITATING AND CONVEYING DEVELOPER, DEVELOPING DEVICE, AND IMAGE FORMING APPARATUS HAVING THE SAME

CROSS-REFERENCE TO RELATED APPLICATIONS

This application is based on and claims priority under 35 USC 119 from Japanese Patent Application No. 2007-260105 filed on Oct. 3, 2007.

BACKGROUND

1. Technical Field

The present invention relates to a member for agitating and conveying a developer, a developing device, and an image forming apparatus using the same 2. Related Art Generally, in image forming apparatuses using an electronic photographing method or an electrostatic recording method, a developing device that develops an electrostatic latent image formed on an electrostatic latent image carrier such as a photosensitive drum is used. As such a developing device, for example, so-called two-component developing devices in which two-component developer (hereinafter, simply referred to as a developer) including a carrier having magnetism and toner having a resin as its primary component are housed in a developing housing having a developing opening facing the electrostatic latent image carrier, a developer holding member (for example, a developing roll) is disposed to face the developing opening of the developing housing, and an auger that conveys the developer inside the developing housing to a developing roll while agitating and conveying the developer is disposed on the rear side of the developing opening of the developing housing have been widely used.

In developing devices of this type using the two-component developing method, it is required to dissolve aggregated toner while supplying toner consumed by a developing operation and to stably convey and supply the developer to the developer holding member.

SUMMARY

According to an aspect of the invention, there is provided a member for agitating and conveying a developer, including: a rotation shaft that rotates in a given direction; a spiral-shaped conveying member that is disposed on an outer circumferential surface of the rotation shaft; and conveys a developer in a shaft direction of the rotation shaft; a protruded agitation section that protrudes, with a gap from the rotation shaft, from the spiral-shaped conveying member toward an upstream side in a developer conveying direction; and agitates the developer; and a diameter directional conveying section that is disposed between adjacent spires of the spiral-shaped conveying member; is disposed in a downstream side in the developer conveying direction with respect to the protruded agitation section, and gives a diameter directional conveying force to the developer.

BRIEF DESCRIPTION OF THE DRAWINGS

Exemplary embodiment(s) of the present invention will be described in detail based on the following figures, wherein.

DETAILED DESCRIPTION

Hereinafter, an embodiment of the present invention will be described.

[Overview of Image Forming Apparatus]

Figure 1:
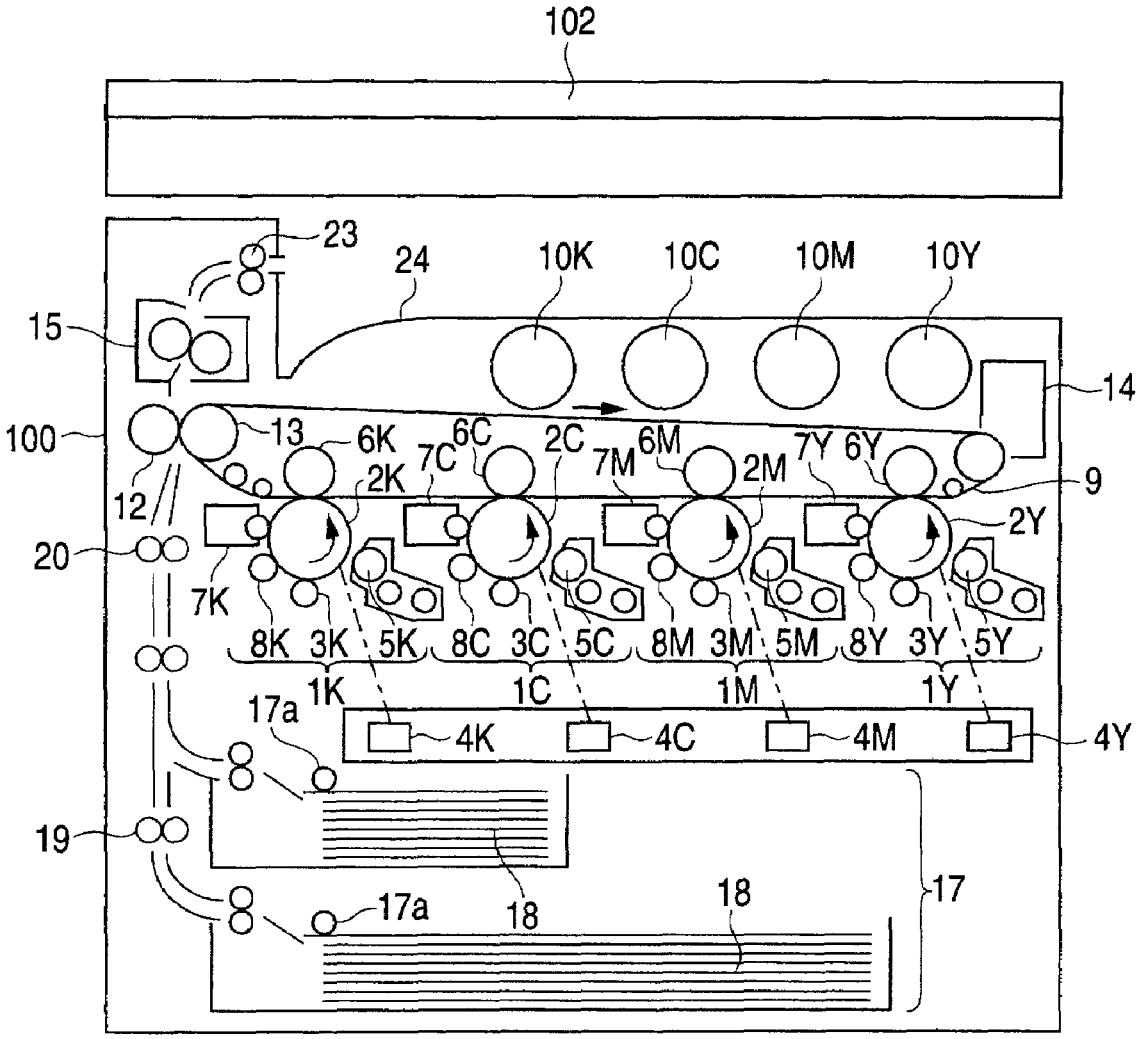
FIG. 1 is a diagram showing a schematic configuration of an image forming apparatus according to an embodiment of the present invention.

First, a schematic configuration of an image forming apparatus according to an embodiment of the present invention will be described with reference to FIG. 1. FIG. 1 is a diagram showing a schematic configuration of a tandem-type color image forming apparatus 100 according to an embodiment of the invention.

To this image forming apparatus 100, color image information of a color document read out by an image reading device 102, color image information transmitted from a personal computer, an image data input device, or the like which is not shown in the figure, and the like are input. The image forming apparatus 100 is configured to perform an image process for the input image information.

In FIG. 1, 1Y, 1M, 1C, and 1K are image forming units that form toner images for colors of yellow (Y), magenta (M), cyan (C), and black (K) and are disposed in series in the order of 1Y, 1M, 1C, and 1K along the moving direction of an endless-shaped intermediate transfer belt 9 suspended on a plurality of suspension rolls. In addition, the intermediate transfer belt 9 is inserted between primary transfer rolls 6Y, 6M, 6C, and 6K that are intermediate transfer bodies, onto which toner images of each color orderly formed by the image forming units 1Y, 1M, 1C, and 1K are transferred in a state overlapped with one another, and are disposed to face photosensitive drums 2Y, 2M, 2C, and 2K that are electrostatic latent image carriers corresponding to the image forming units 1Y, 1M, 1C, and 1K, and is formed to be cyclically movable in the direction of the arrow. The toner images of each color transferred in several layers onto the intermediate transfer belt 9 are transferred in aggregate onto a recording sheet 18 serving as a recording medium fed by a paper feed cassette 17 or the like, fixed on the recording sheet 18 by a fixing device 15, and the recording sheet 18 on which a color image is formed is configured to be discharged outside.

Here, the image reading device 102 is configured to illuminate the document placed on a platen glass by using a light source not shown in the figure and read out an image reflected from the document through a scanning optical system with a given resolution by using an image reading component constituted by a CCD sensor or the like.

The image forming units 1Y, 1M, 1C, and 1K has a same configuration. Basically, the image forming units 1Y, 1M, 1C, and 1K include photosensitive drums 2Y, 2M, 2C, and 2K which rotate at a given rotation speed along directions of arrows, charging rolls 3Y, 3M, 3C, and 3K serving as a charging unit for uniformly charging surfaces of the photosensitive drums 2Y, 2M, 2C, and 2K, exposure devices 4Y, 4M, 4C, and 4K which form electrostatic latent images by exposing images corresponding to each color on the surfaces of the photosensitive drums 2Y, 2M, 2C, and 2K, developing devices 5Y, 5M, 5C, and 5K which develop the electrostatic latent images formed on the photosensitive drums 2Y, 2M, 2C, and 2K, toner cartridges 10Y, 10M, 10C, and 10K which are detachably attached and supply toners of given colors to the developing devices 5Y, 5M, 5C, and 5K, drum cleaning devices 7Y, 7M, 7C, and 7K, and the like.

According to this embodiment, in the photosensitive drums 2Y, 2M, 2C, and 2K, photosensitive layers made of an organic photosensitive material, an amorphous selenium-based photosensitive material, an amorphous silicon-based photosensitive material, or the like are formed on the surfaces of drums made of a metal material which rotate in the direction of the arrows, and the charging rolls 3Y, 3M, 3C, and 3K are brought into contact with the surfaces of the photosensitive drums 2Y, 2M, 2C, and 2K so as to charge the photosensitive layers to have a given electric potential.

An image forming process in the image forming apparatus having the above-described configuration for a case where the image forming unit 1Y forms a yellow toner image will be described as a representative example.

First, the surface of the photosensitive drum 2Y is charged uniformly by the charging roll 3Y. Next, scanning exposure corresponding to a yellow image is performed by a laser beam output from the exposure device 4Y, for example, based on the image information read out by the image reading device 102, and thereby an electrostatic latent image corresponding to the yellow image is formed on the surface of the photosensitive drum 2Y.

The electrostatic latent image corresponding to this yellow image is formed as a yellow toner image by the developing device 5Y and is transferred primarily on the intermediate transfer belt 9 depending on a pressure contact force and an electrostatic attraction force of the primary transfer roll 6Y constituting a part of the primary transferring unit. Yellow toners remaining on the photosensitive drum 2Y after the primary transfer are scraped out by the drum cleaning device 7Y. Thereafter, the surface of the photosensitive drum 2Y is electrically neutralized by a neutralization device 8Y and then, charged again by the charging roll 3Y for the next image forming cycle.

According to the image forming apparatus 100 forming a multiple color image, the above-described image forming process is performed in image forming units 1M, 1C, and 1K at timings in consideration of relative positional differences of the image forming units 1Y, 1M, 1C, and 1K, and a full-color toner image is formed on the intermediate transfer belt 9 in an overlapped state. As the intermediate transfer belt 9, for example, a belt that is formed in an endless shape by forming a synthetic resin film such as polyimide having flexibility in a band shape and connecting both ends of the synthetic resin film formed in the band shape in the longitudinal direction together by a welding means or the like may be used.

The full-color toner image that has been primarily transferred on the intermediate transfer belt 9 is secondarily transferred on the recording sheet 18 that is conveyed to a secondary transfer position at a given timing depending on a pressure contact force and an electrostatic attraction force between a backup roll 13 supporting the intermediate transfer belt 9 and a secondary transfer roll 12 that is pressingly contacted with the backup roll 13 at a given timing. The remaining toners on the intermediate transfer belt 9 which could not be secondarily transferred on the recording sheet 18 are conveyed to the belt cleaning device 14 in a state of being attached on the intermediate transfer belt 9 and removed from the intermediate transfer belt 9 by the belt cleaning device 14, and thereby a next image forming process is prepared.

The recording sheet 18 of a given size is fed from a paper feed cassette 17 serving as a recording sheet accommodation unit, which is disposed in a lower portion of the image forming apparatus 100, by a paper feed roll 17*a*. The fed recording sheet 18 is conveyed to a secondary transfer position of the intermediate transfer belt 9 at a given timing by a plurality of conveying rolls 19 and resist rolls 20. On the recording sheet 18, as described above, a full-color toner image is transferred in aggregate from the intermediate transfer belt 9 by the backup roll 13 and the secondary transfer roll 12 serving as a secondary transferring unit.

The recording sheet 18 on which the full-color toner image is secondarily transferred from the intermediate transfer belt 9 is separated from the intermediate transfer belt 9 and then is conveyed to the fixing device 15 that is disposed on the down stream side of the secondary transferring unit. Then, the toner image is configured to be fixed on the recording sheet 18 depending on heat and pressure by this fixing device 15. The recording sheet 18 after the fixing process is discharged on a discharge tray 24 through a discharge roll 23.

[Developing Device]

Figure 2:
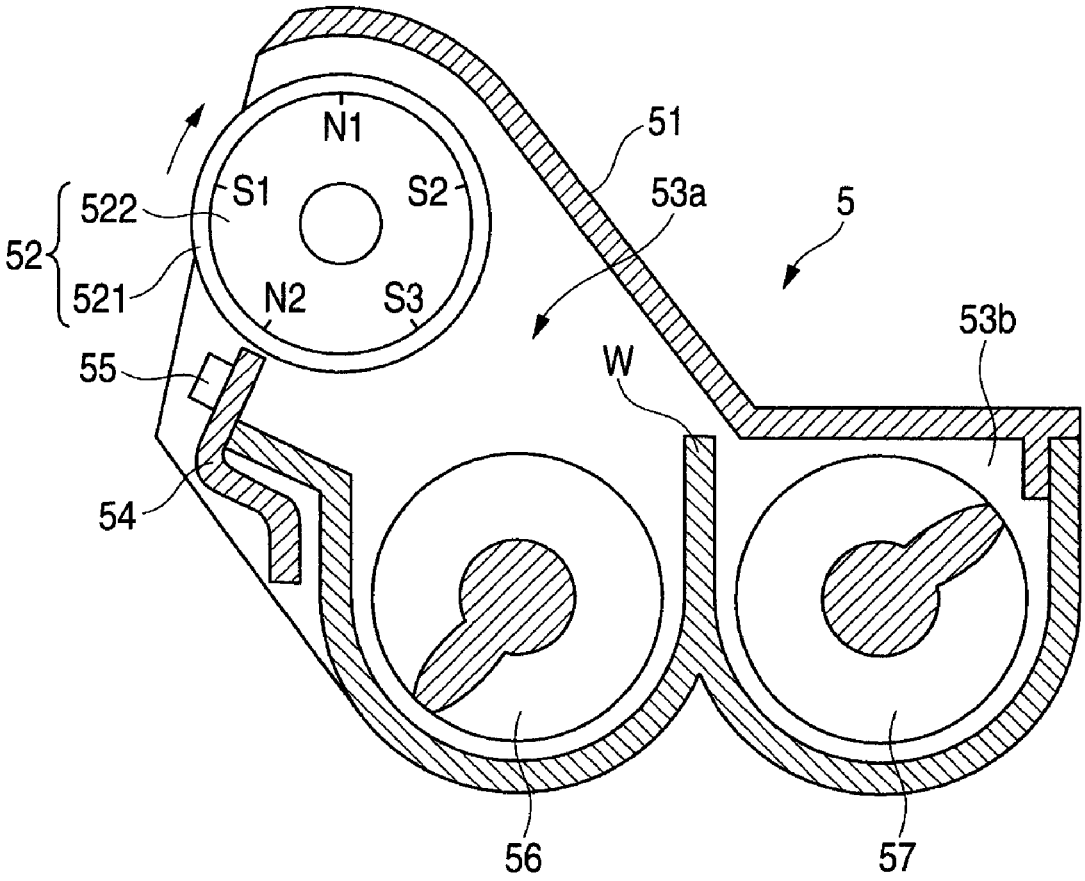
FIG. 2 is a schematic diagram showing the configuration of a developing device according to an embodiment of the present invention.
Figure 3:
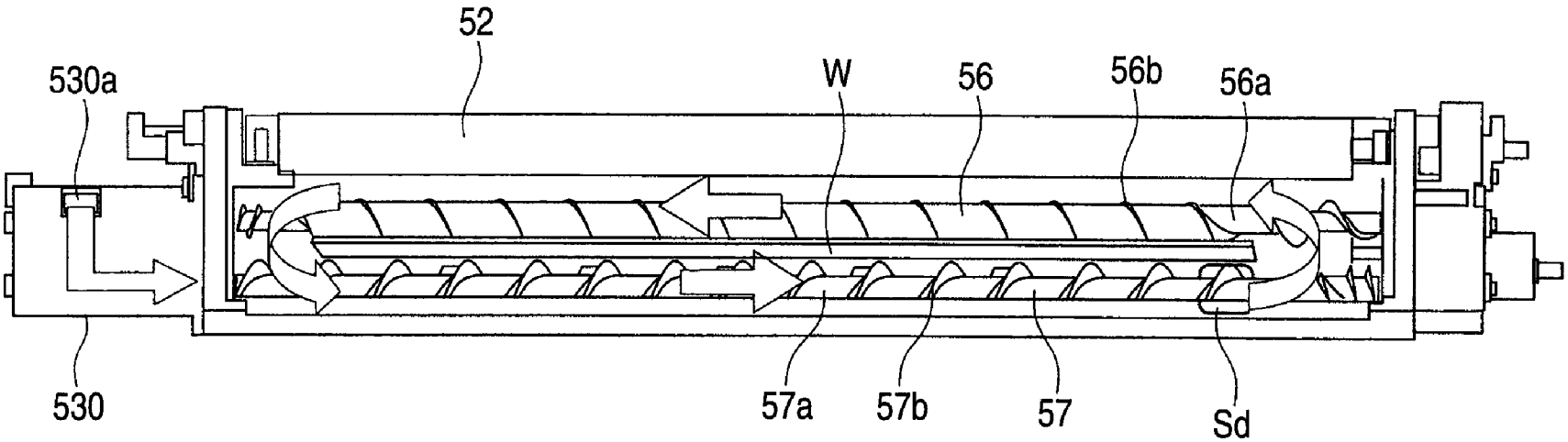
FIG. 3 is a schematic diagram for describing the configuration of a flow path of a developing device according to an embodiment of the present invention.

Next, the configuration of a developing device according to an embodiment of the present invention will be described with reference to FIGS. 2 and 3. Here, FIG. 2 is a schematic diagram showing the configuration of a developing device according to an embodiment of the present invention, and FIG. 3 is a schematic plan view for describing the configuration of a flow path of a developing device according to an embodiment of the present invention. The developing devices 5Y, 5M, 5C, and 5K and constituent members thereof have same configurations. For the simplification of a description, hereinafter each reference sign is represented by a common representation (for example, a developing device 5).

As shown in FIG. 2, a developing device 5 according to this embodiment includes a first developer housing section 53*a* in which a developing housing 51 as an example of a developer housing chamber having a portion facing the photosensitive drum 2 is opened and housing two-component developers is disposed, a developing roll 52, serving as a developer holding member, is disposed to face the opening of the developing housing 51, and the two-component developer is housed in a portion adjacent to the developing roll 52 of the developing housing 51 and a second developer housing section 53*b* that is disposed to be adjacent to the first developer housing section 53*a* through a partitioned wall W and communicates with the first developer housing section 53*a* in both end portions in the direction of the shaft. Each of the first developer housing section 53*a* and the second developer housing section 53*b* according to this embodiment has a space for housing the two-component developer. In the first developer housing section 53*a*, a supply auger 56 of a spiral shape, which is an example of a first agitating and conveying member for conveying the two-component developer in a given shaft direction (for example, from the inner side to the front side in the figure), is disposed. In addition, in the second developer housing section 53*b*, an admix auger 57 of a spiral shape which is an example of a second agitating and conveying member for conveying the two-component developer in a direction opposite to the supply auger 56 (for example, from the front side to the inner side in FIG. 2) is disposed.

According to this embodiment, the developing roll 52 includes a developing sleeve 521 that rotates in a given direction (in this example, the clockwise direction) in a developing process and a magnet roll 522 that is installed to be fixed inside this developing sleeve 521.

Here, the developing sleeve 521 is disposed to rotate in a given direction and to face the photosensitive drum 2 with a given distance maintained therebetween in an area (developing area) that is an opening portion of the developing housing 51 and faces the photosensitive drum 2. To this developing sleeve 521, a bias power source (not shown) for applying a developing bias formed by a DC bias that is generated by superposing alternating currents is connected.

The magnet roll 522 according to this embodiment is formed in a roll shape by disposing a plurality of magnet members in a circumferential direction. The magnet roll 522 includes conveying magnetic poles N1 or pickoff magnetic poles S2 which are disposed on the downstream side of the developing magnetic pole S1, for example, with a given angular intervals therebetween and trimming magnetic poles N2 or pickup magnetic poles S3 on the upstream side of the developing magnetic pole S1, along the developing magnetic pole S1 and the rotation direction of the developing roll 52 which are disposed in correspondence with developing areas The disposition or the number of magnetic poles inside the magnet roll 522 may be appropriately selected.

In addition, below the trimming magnetic pole N2 disposed inside the developing roll 52, a layer-thickness regulation member 54 of an approximate "<" shape which extends along the direction of the shaft of the developing roll 52 such that the facing side of the layer-thickness regulation member closely approaches the developing roll 52 with a given gap is disposed, and is configured to regulate the two-component developer on the developing roll 52 at a given amount (layer thickness).

As clearly shown in FIG. 3, according to this embodiment, in a portion near one end of the first developer housing section 53*a* and the second developer housing section 53*b* in the shaft direction, a toner supply section 530 having a toner supply opening 530*a* is disposed. In addition, below the end portion of the second developer housing section 53*b* on the downstream side of the conveying direction of the developer, a density sensor Sd for detecting the density of toner contained in the two-component developer is disposed. When the toner density inside the developer housing sections 53*a* and 53*b* is determined to be lower than a given density range due to a developing action or the like based on the result of detection of this density sensor Sd, toner is supplied to a toner supply section 530 through the toner supply opening 530*a* from the toner cartridge 10, and the toner is configured to be supplied inside the second developer housing section 53*b*. According to this embodiment, the two-component developer includes toner and a carrier.

According to this embodiment, the supply auger 56 housed in the first developer housing section 53*a* has a spiral-shaped blade 56*b* that agitates and conveys the two-component developer in the direction of the rotation shaft 56*a* (in FIG. 3, from the right side to the left side) and is formed on the circumference of the rotation shaft 56*a* and is disposed inside the first developer housing section 53*a* such that the spiral-shaped blade 56*b* is positioned close to a near wall (see FIG. 2).

In addition, the admix auger 57 housed in the second developer housing section 53*b* has a spiral-shaped blade 57*b* formed on the circumference of the rotation shaft 57*a* for agitating and conveying the two-component developer in a direction opposite to that of the supply auger 56 (in FIG. 3, from the left side to the right side), and is disposed inside the second developer housing section 53*b* such that the spiral-shaped blade 57*b* is positioned close to a near wall (see FIG. 2). The supply auger 56 housed in the first developer housing section 53*a* and the admix auger 57 housed in the second developer housing section 53*b* are partitioned by a partition wall W, and the first developer housing section 53*a* and the second developer housing section 53*b* are configure to communicate with each other by opening both end portions of the partition wall in the shaft direction (longitudinal direction), and thereby a developer circulating and conveying path for circulating and conveying the two-component developer in a given direction (in FIG. 3, a counterclockwise direction represented by an arrow) is formed. In addition, in the developing device according to this embodiment, a developer discharge opening (not shown), for example, is disposed along the conveying direction of the developer in an end portion of the supply auger 56 on the downstream side in the shaft direction, and thereby so-called a trickle method in which deteriorated two-component developer is slowly discharged is used.

[Member for Agitating and Conveying Developer]

Figure 4:
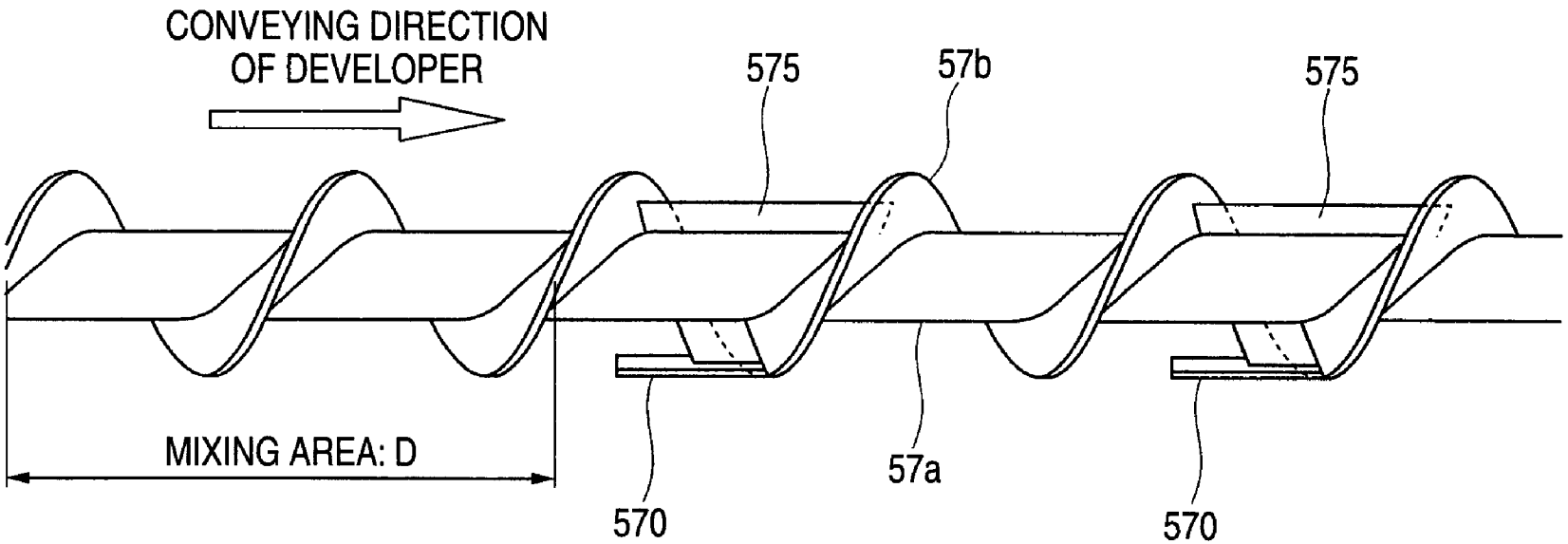
FIG. 4 is a schematic diagram for describing the configuration of a member for agitating and conveying a developer according to an embodiment of the present invention.
Figure 5:
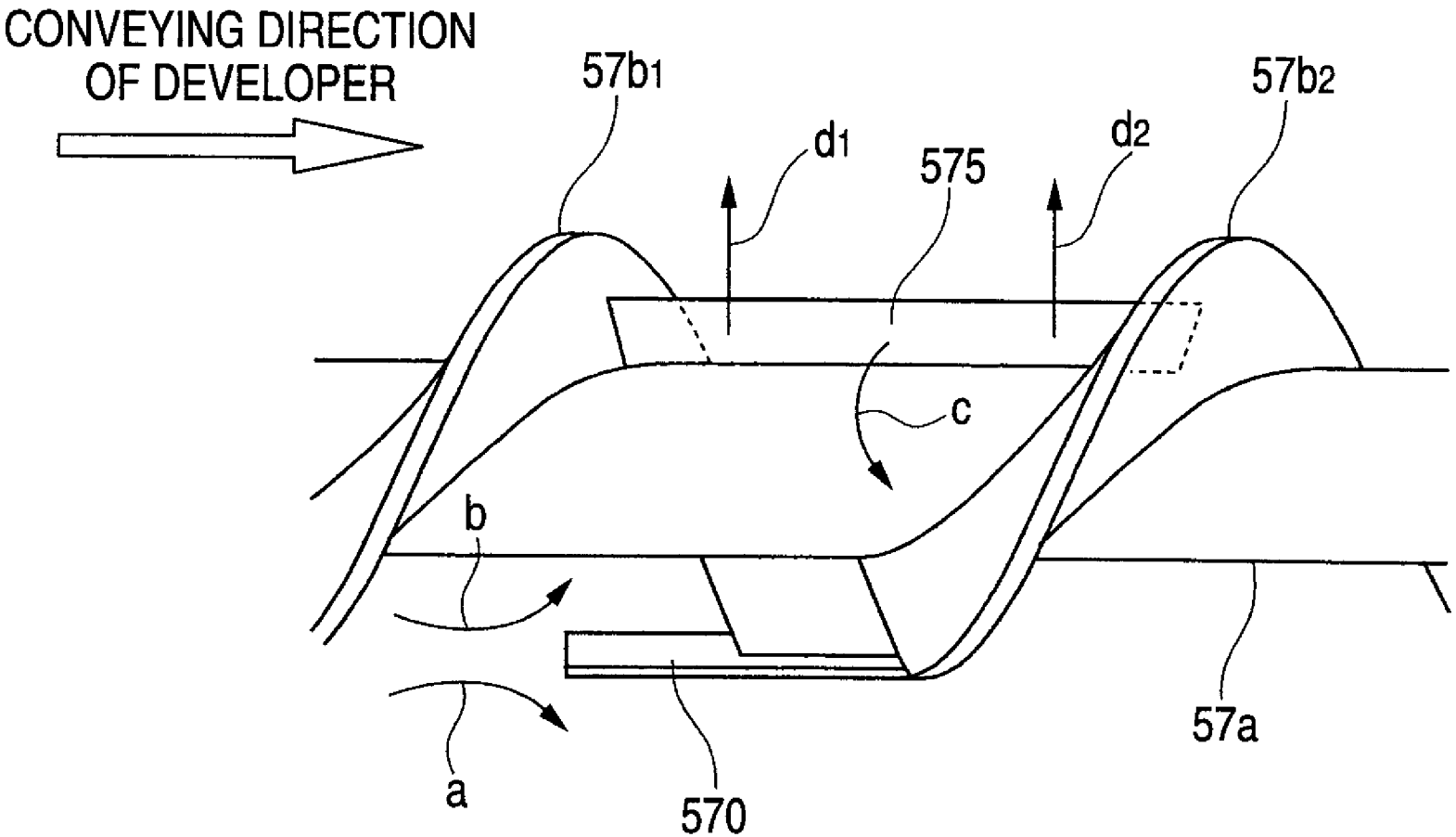
FIG. 5 is an enlarged schematic diagram for describing actions of a protrusion section and a plate-shaped section according to an embodiment of the present invention.
Figure 6A:
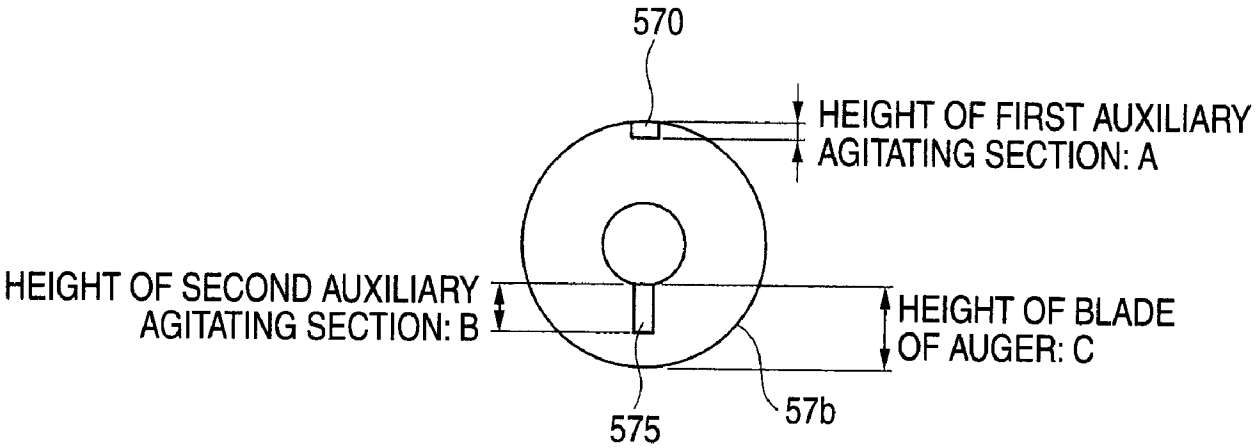
FIG. 6A is a schematic cross-sectional view for describing the heights and dispositional phases of the protrusion section and the plate-shaped section.
Figure 6B:
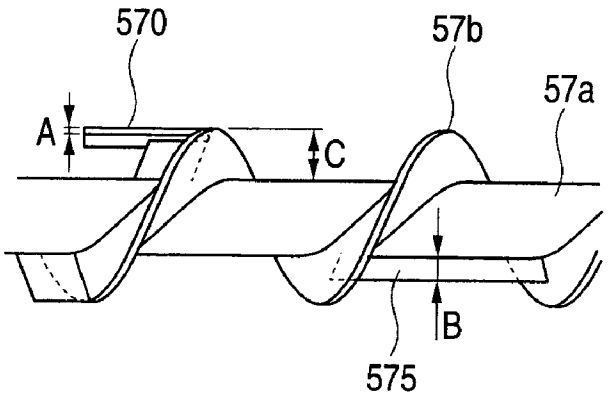
FIG. 6B is a schematic diagram showing a modified example of disposition of the protrusion section and the plate-shaped section in a shaft direction.

The detailed configuration and function of an admix auger 57 of a member for agitating and conveying a developer according to an embodiment of the present invention will be additionally described with reference to FIGS. 4 to 7. Here, FIG. 4 is a schematic diagram for describing the configuration of the member for agitating and conveying a developer. FIG. 5 is an enlarged schematic diagram, in which a part of FIG. 4 is enlarged, for describing the action of a protrusion section as an example of a protruded agitating and conveying section according to this embodiment and a plate-shaped section as a diameter directional conveying section according to this embodiment. In addition, FIG. 6A is a schematic cross-sectional view for describing the lengths in the radial direction of the rotation shaft and phases of the protrusion section and the plate-shaped section. FIG. 6B is a schematic diagram showing a modified example of disposition of the protrusion section and the plate-shaped section in the shaft direction. FIGS. 7A to 7E are schematic diagrams for describing an example of the front end shape of the protrusion section.

As shown in FIG. 4, the admix auger 57 has a spiral-shaped blade 57*b* which is formed by being wound on the circumference of a rotation shaft 57*a* in a given direction. To the outer circumferential part of the spiral-shaped blade 57*b*, a protrusion section 570 in the shape of a protrusion (bar) that protrudes in the shaft direction toward the upstream side of the conveying direction of the developer is attached, and a plate-shaped section 575 in the shape of a plate that extends between the spiral-shaped blades 57*b* in the shaft direction to be overlapped with the protrusion section 570 in the shaft direction is attached to the rotation shaft 57*a* on the downstream side of the protrusion section 570. The protrusion section 570 and the plate-shaped section 575 form an auxiliary agitating and conveying section pair. By forming a plurality of the auxiliary agitating and conveying pairs in the direction of the rotation shaft 57*a*, the generation of soft blocking for the toner is suppressed by the action described below.

As shown in FIG. 5 in an enlarged scale, first, the two-component developer that has been agitated and conveyed in a given shaft direction by the spiral-shaped blade 57$b_1$ is divided into both the circumferential side (arrow a) and the rotation shaft side (arrow b) by the protrusion section 570 formed to protrude on the upstream side of the conveying direction of the developer. The developer introduced on the circumferential side is brought into contacted with the wall of the developing housing 51 (the second developer housing section 53*b*), the protrusion section 570 of which approaches the blade 57*b* and the circumferential surface of the protrusion section 570, and thereby soft blocking toner is released.

The developer introduced on the rotation shaft side is agitated and conveyed (arrow c) on the circumference of the rotation shaft by the plate-shaped section 575 disposed on the downstream side, and thereby soft blocking for the toner is released and a conveying force in the shaft direction is weakened by the plate-shaped section 575. Accordingly, developer staying between the spiral-shaped blades 57$b_1$ and 57$b_2$ is forced to be forwarded in the outer circumferential direction (arrow $d_1$) again, and thereby soft blocking is released by the above-described action of the protrusion section 570 overlapped in the shaft direction. For the developer (arrow $d_2$) introduced into the outer circumferential area not overlapped with the protrusion section 570, soft blocking is released by action of the circumferential part of the spiral-shaped blade 57$b_2$ disposed on the downstream side or another protrusion section 570.

Although the number of the above-described auxiliary agitating and conveying pair 570 and 575 may be one, however, a plurality of the auxiliary agitating and conveying pairs disposed in the shaft direction can dissolve soft blocking for the toner more assuredly. In addition, the numbers of the protrusion sections 570 and the plate-shaped sections 575 may not be the same for forming the pairs, and the numbers thereof may be appropriately selected. For example, the number of the plate-shaped sections 575 may be smaller than that of the protrusion sections 570 for suppressing stay of the developer in the shaft direction.

In addition, although the protrusion section 570 may be disposed to extend over the spiral-shaped blades 57$b_1$, 57$b_2$, however, it is preferable that the protrusion section is formed to extrude in the shaft direction from the outer circumferential surface of the spiral-shaped blade 57*b* toward the upstream side of the conveying direction of the developer, in view of acquiring a smooth flow of the developer by suppressing stay of the developer which is caused by weakening the conveying force in the shaft direction due to application of the conveying force for conveying the developer in the radial direction of the rotation shaft 57*a* over the blades. Here, the outer circumferential surface of the spiral-shaped blade 57*b* includes not only the outer circumferential edge of the spiral-shaped blade 57*b* but also an area near the outer circumferential edge of the spiral-shaped blade 57*b*, that is, the outer circumferential edge of the spiral-shaped blade 57*b* and the surface of the blade 57*b* positioned from the outer circumferential edge to the rotation shaft 57*a* side.

In addition, although the plate-shaped section 575 is not needed to be disposed over the spiral-shaped blades 57$b_1$ and 57$b_2$, it is preferable that the plate-shaped section is disposed over the spiral-shaped blades 57$b_1$ and 57$b_2$ in the shaft direction of the rotation shaft 57*a*. In such a case, since there is no gap between the spiral-shaped blades 57$b_1$ and 57$b_2$ in the shaft direction, stay of the developer on the circumference of the rotation shaft without application of the conveying force in the radial direction of the rotation shaft 57*a* by the developer's passing through a space between the blade 57$b_1$ and the plate-shaped section 575 or a space between the blade 57$b_2$ and the plate-shaped section 575 in the direction of the rotation shaft and getting out of the plate-shaped section 575 can be suppressed in a case where the plate-shaped section 575 conveys the developer in the radial direction of the rotation shaft 57*a*.

In addition, as shown in FIG. 6A, it is preferable that heights of the sections are set to satisfy a relationship of "$B \leqq C-A$", where the height (thickness) of the protrusion section 570 in the diameter direction is A, the height (thickness) of the plate-shaped section 575 in the diameter direction (thickness) is B, and the height (thickness) of the spiral-shaped blade 57*b* in the diameter direction (thickness) is C. By satisfying this relationship, overlap between the protrusion section 570 and the plate-shaped section 575 in the diameter direction can be prevented, and whereby it is possible to acquire a smooth flow of the developer in the shaft direction.

In view of effectively suppressing the stay of the developer in the shaft direction, it is preferable that the height (thickness) A of the protrusion section 570 in the diameter direction is equal to or smaller than half the height (thickness) C of the spiral-shaped blade 57*b* in the diameter direction.

In addition, it is preferable that the phases of the protrusion section 570 and the plate-shaped section 575 with respect to the center of rotation are different from each other. As described above, by setting the dispositional phases of the protrusion section 570 and the plate-shaped section 575 differently, it is possible to suppress the stay of the developer. In addition, in view of acquiring a smoother flow of the developer in the shaft direction, it is preferable that the phases of the protrusion section 570 and the plate-shaped section 575, as shown in FIG. 6A, have a difference equal to or larger than ±90° (in this example ±180°)

In addition, as shown in FIG. 6B, although the protrusion section 570 and the plate-shaped section 575 may be disposed not to be overlapped with each other in the shaft direction, however, developer near the rotation shaft of the developer agitated and conveyed by the protrusion section 570 may act on the plate-shaped section 575 before staying on the circumference of the shaft, and accordingly, it is preferable that the protrusion section 570 and the plate-shaped section 575 are disposed such that extended areas thereof are overlapped with each other in the shaft direction (see FIGS. 4 and 5).

Figure 7A:
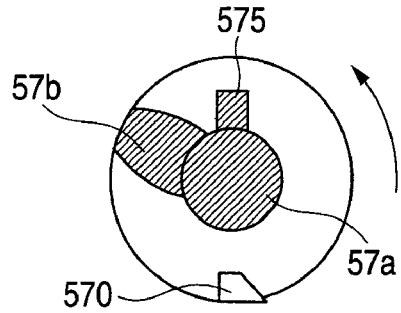
FIGS. 7A to 7E are schematic diagrams for describing an example of the front end shape of the protrusion section.
Figure 7B:
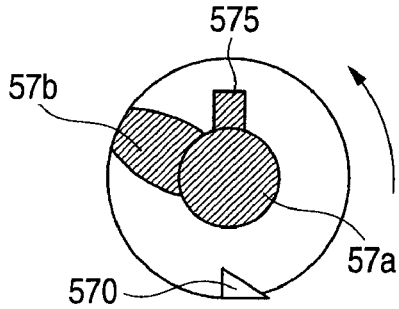
Figure 7C:
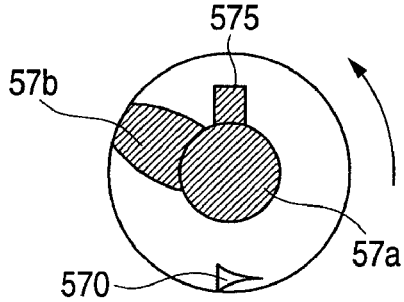
Figure 7D:
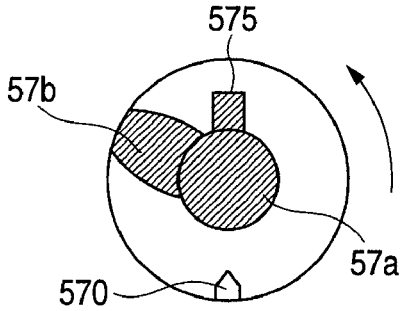
Figure 7E:
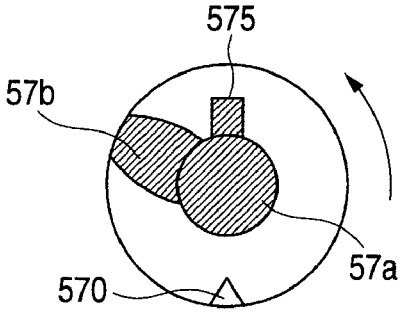

In view of performing an action for separating the developer into the outer circumferential side and the rotation shaft side more smoothly by using the protrusion section 570, as shown in FIGS. 7A to 7E, it is preferable that the shape of the front end portion of the protrusion section 570 is formed to be sharpened toward the downstream side of the rotation direction of the rotation shaft 57*a*. Here, FIGS. 7A and 7B show examples in which the front end portion of each polygon on the downstream side of the rotation direction is sharpened in the shape of a straight line, and FIG. 7C shows an example in which the front end portion is sharpened in the shape of a circular arc. In addition, FIGS. 7D and 7E show examples in which each front end portion is formed in the shape of a mountain on the inner side (rotation shaft side 57*a*). As described above, by forming the protrusion section 570, a sharpened front end portion enters into the boundary surface of the developer, and accordingly it is possible to promote the separation action of the developer into the outer circumferential side and the rotation shaft side without interrupting conveying of the developer in the shaft direction. In addition, in order to reduce resistance for the protrusion section to be inserted into the boundary surface of the developer to be a minimum level, as described above, although it is preferable that the front end portion of the protrusion section 570 is sharpened (see FIGS. 7A to 7C), the shape of the front end portion (see FIGS. 7D and 7E) in which the sectional area decreases (increases from the most downstream side of the rotation direction to the upstream side) toward the downstream side of the rotation direction (in this example, the counterclockwise direction) may be used.

Referring back to FIG. 4, on the upstream side of the member for agitating and conveying a developer 57 according to this embodiment, a mixing area D in which the protrusion section 570 and the plate-shaped section 575 above-described are not provided is configured. This mixing area D on the upstream side enables the toner supplied from the toner supply section 530 and the developer inside the second developer housing section 53*b* to be sufficiently agitated and conveyed. In the mixing area D according to this embodiment, the conveying speed of the developer in the shaft direction is configured to be increased relative to that in an agitating and conveying area in which the protrusion section 570 on the downstream side and the plate-shaped section 575 are disposed, and thereby the density of the developer in the mixing area D is set to be lower than that on the downstream side.

Generally, when the protrusion section 570 and the plate-shaped section 575 are provided up to the mixing area D, stay of the developer in the area is promoted, and a phenomenon that the supplied toner floats above the staying developer occurs. Thus, by disposing the above-described mixing area D having a lowered density of the developer on the upstream side of the agitating and conveying area in which the protrusion section 570 and the plate-shaped section 575 are disposed, the supplied toner and the circulating developer can be mixed and agitated uniformly.

In particular, this mixing area D is formed as an area having one pitch or more of the blade 57*b* of the end portion of the admix auger 57 on the upstream side corresponding to the opening portion of the partitioned wall W that is a communication portion between the first developer housing section 53*a* and the second developer housing section 53*b*. It is preferable that the mixing area is formed as two to three-pitch area.

For the mixing area D in which the density of the developer is lowered, an embodiment in which the protrusion section 570 and the plate-shaped section 575 are not disposed as described above may be used. However, the mixing area D may be aggressively formed so as to lower the density of the developer by forming the auger pitch (pitch of the blade 57*b*) to be larger than the pitch of the blade on the downstream side or forming the diameter of the auger shaft (rotation shaft 57*a*) to be smaller than that on the downstream side.

In addition, in order to appropriately supply the toner based on the developing operation, the density of the developer flowing in the shaft direction is preferably measured, and accordingly, it is preferable that the protrusion section 570 and the plate-shaped section 575 which reduce the conveying force in the shaft direction by applying a conveying force in a radial direction of the rotation shaft 57*a* are not disposed in the vicinity of the density sensor Sd (see FIG. 3) disposed on the downstream side of the admix auger 57.

In other words, in this embodiment, it is preferable to set the protrusion section 570 and the plate-shaped section 575 as an area located on the downstream side of the mixing area D and the upstream side of the density sensor Sd.

Figure 8:
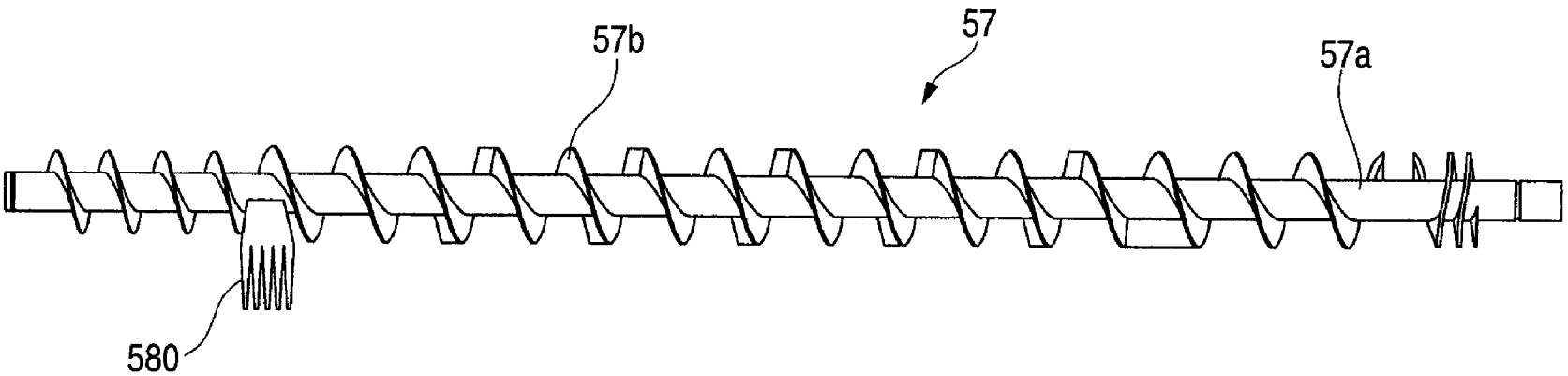
FIG. 8 is a schematic diagram of a mixing area according to another embodiment of the present invention.

As another embodiment of the mixing area D in which the supplied toner and circulating developer are mixed, for example, as shown in FIG. 8, an OHP sheet (so-called mylar) 580 that has a rotation diameter to contact the wall of the second developer housing section 53*b* and have slits may be attached to the rotation shaft 57*a*. In such a case, it is possible to sufficiently mix and agitate the supplied toner and the developer, and the mixed developer can be smoothly conveyed in the shaft direction without staying long by arranging the slits.

Figure 9A:
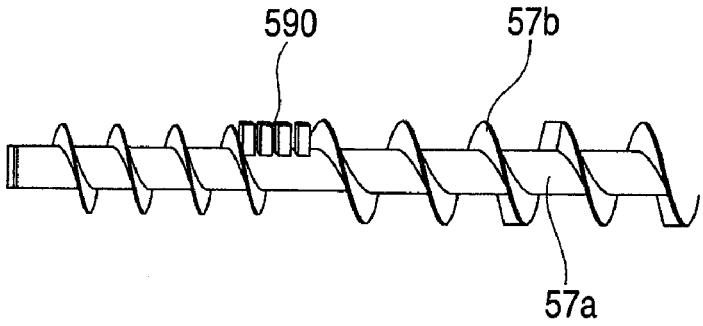
FIGS. 9A to 9C are schematic diagrams of a mixing area according to another embodiment of the present invention.

As another embodiment, for example, as shown in FIG. 9A, a rib 590 having a comb-teeth like shape which is installed to the rotation shaft 57*a* may be provided. In such a case, it is possible to sufficiently mix and agitate the supplied toner and the developer, and the aggregation of the supplied toner can be released in an aggressive manner.

Figure 9B:
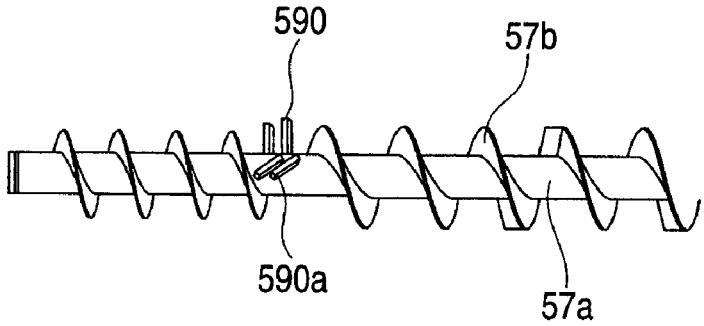
Figure 9C:
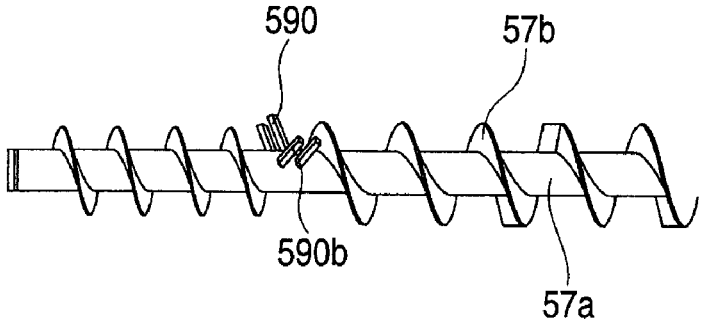

In addition, regarding the above-described rib 590, parts of the ribs 590*a* may be disposed to be tilted as shown in FIG. 9B, and as shown in FIG. 9C, parts of the ribs 590*b* may be disposed to have different phases with respect to the center of the rotation. In such a case, it is possible to sufficiently mix and agitate the supplied toner and the developer while a smoother flow of the developer in the shaft direction is acquired, and the aggregation of the supplied toner can be released in an aggressive manner.

In addition, application of the member for agitating and conveying a developer according to an embodiment of the present invention is not limited to the above-described developing apparatus, and it is possible to apply it as a member for agitating and conveying a developer, which is disposed in a developer conveying path for agitating and conveying the developer. In addition, although each embodiment (detailed example) may be performed individually, it is apparent that the above-described embodiments may be performed in combination.

What is claimed is:

1. A member for agitating and conveying a developer, comprising:

a rotation shaft that rotates in a given direction;

a spiral-shaped conveying member that is disposed on an outer circumferential surface of the rotation shaft without a gap between the spiral-shaped conveying member and the rotation shaft; and conveys a developer in an axial direction of the rotation shaft;

a protruded agitation section that protrudes, with a gap from the rotation shaft, from the spiral-shaped conveying member toward an upstream side in a developer conveying direction; and agitates the developer; and a radial direction conveying section that is disposed between adjacent spires of the spiral-shaped conveying member; is disposed in a downstream side in the developer conveying direction with respect to the protruded agitation section.

2. The member for agitating and conveying a developer according to claim 1, wherein the radial direction conveying section extends in the axial direction over between the adjacent spires of the spiral-shaped conveying member.

3. The member for agitating and conveying a developer according to claim 1, wherein extended areas of the protruded agitation section and the radial direction conveying section are overlapped with each other in the axial direction.

4. The member for agitating and conveying a developer according to claim 1, wherein a cross-sectional area of the protruded agitation section in a direction perpendicular to the axial direction increases from a downstream side to an upstream side in a rotation direction of the rotation shaft.

5. The member for agitating and conveying a developer according to claim 1, which satisfies a relationship of $C-A \geqq B$, wherein A represents a thickness, in a radial direction of the rotation shaft of the protruded agitation section, B represents a length of the radial direction conveying section in the radial direction of the rotation shaft, and C represents a height of the spiral shaped blade on the circumference of the rotation shaft.

6. The member for agitating and conveying a developer according to claim 5, wherein the following relationship is satisfied:

$A \leqq C/2$.

7. A developing device comprising:

a developer housing chamber that houses a developer comprising a toner and a carrier;

a developer holding member that is disposed in the developer housing chamber; and carries the developer;

a first developer housing section that houses the developer to be supplied to the developer holding member;

a first developer conveying member that is disposed in the first developer housing section; comprises a first rotation shaft and a first spiral-shaped blade on a circumference of the first rotation shaft without a gap between the first spiral-shaped blade and the first rotation shaft; and agitates and conveys the developer in a shaft direction of the first rotation shaft;

a second developer housing section that transports the developer to the first developer housing section;

a second developer conveying member that is disposed in the second developer housing section; comprises a second rotation shaft and a second spiral-shaped blade on the circumference of the second rotation shaft without a gap between the second spiral-shaped blade and the second rotation shaft; and conveys the developer in a shaft direction of the second rotation shaft;

a protruded agitation section that protrudes, with a gap from the second rotation shaft, from the second spiral-shaped blade toward an upstream side in a developer conveying direction; and a plate-shaped radial direction conveying section that is disposed between adjacent spires of the second spiral-shaped blade; and is disposed in a downstream side in the developer conveying direction with respect to the protruded agitation section.

8. The developing device according to claim 7, further comprising:

a density sensor that is disposed in the developer housing chamber on a side facing the second developer conveying member; and detects density of the toner in the developer and, wherein the protruded agitation section and the plate-shaped radial direction conveying section are disposed on an upstream side of the second developer conveying member in the developer conveying direction with respect to the density sensor.

9. An image forming apparatus comprising:

an electrostatic latent image carrier that carries an electrostatic latent image on a surface thereof;

the developing device according to claim 8 that forms a toner image by developing the electrostatic latent image; and a transferring unit that transfers the toner image on a recording sheet.

10. An image forming apparatus comprising:

an electrostatic latent image carrier that carries an electrostatic latent image on a surface thereof;

the developing device according to claim 7 that forms a toner image by developing the electrostatic latent image; and a transferring unit that transfers the toner image on a recording sheet.

11. The developing device according to claim 7, which satisfies a relationship of $C-A \geqq B$, wherein A represents a thickness, in a radial direction of the second rotation shaft of the protruded agitation section, B represents a length of the plate-shaped radial direction conveying section in the radial direction of the rotation shaft, and C represents a height of the spiral shaped blade on the circumference of the second rotation shaft.

12. The developing device according to claim 11, wherein the following relationship is satisfied:

$A \leqq C/2$.

* * * * *